US009611691B1

(12) United States Patent
Hunter et al.

(10) Patent No.: US 9,611,691 B1
(45) Date of Patent: Apr. 4, 2017

(54) IN-CABINET STEP STOOL

(71) Applicants: John Scott Hunter, Olathe, KS (US); Stefanie R. Hunter, Olathe, KS (US)

(72) Inventors: John Scott Hunter, Olathe, KS (US); Stefanie R. Hunter, Olathe, KS (US)

( * ) Notice: Subject to any disclaimer, the term of this patent is extended or adjusted under 35 U.S.C. 154(b) by 0 days.

(21) Appl. No.: 15/049,850

(22) Filed: Feb. 22, 2016

(51) Int. Cl.

| | |
|---|---|
| ***E06C 1/00*** | (2006.01) |
| ***A47B 77/00*** | (2006.01) |
| ***A47K 17/02*** | (2006.01) |
| ***E06C 9/08*** | (2006.01) |
| ***A47C 12/00*** | (2006.01) |

(52) U.S. Cl.
CPC ..... *E06C 1/005* (2013.01); *A47B 77/00* (2013.01); *A47C 12/00* (2013.01); *A47K 17/028* (2013.01); *E06C 9/08* (2013.01)

(58) Field of Classification Search
CPC ..... E04F 11/00; E04F 11/02; E04F 11/0201; E04F 11/04; E04F 11/06; E04F 11/062; E04F 11/064; E06C 1/005; E06C 9/06; E06C 9/10; E06C 9/08; E06C 9/085; A47B 77/10; A47B 46/005; A47B 2220/05; A47B 3/14; A47B 77/00; A47C 9/06; A47C 12/00; A47C 10/00; A47C 12/02; A47K 17/028
USPC ..... 182/33.6, 33, 35, 91, 19; 4/621; 312/235.1; 248/240, 240.1, 240.2; 108/137
See application file for complete search history.

(56) References Cited

U.S. PATENT DOCUMENTS

| | | | | | |
|---|---|---|---|---|---|
| 395,539 | A * | 1/1889 | Bockenheuser | A47C 12/02 | 182/33 |
| 486,320 | A * | 11/1892 | Batt | E06C 1/005 | 108/99 |
| 1,587,002 | A * | 6/1926 | Jones | E06C 1/005 | 182/33.5 |
| 1,621,539 | A * | 3/1927 | Hemingway | E04F 11/04 | 182/77 |
| 2,555,149 | A * | 5/1951 | Mushta | E06C 1/005 | 182/163 |
| 2,775,499 | A * | 12/1956 | Gleitsman | E06C 1/005 | 182/129 |
| 2,858,056 | A * | 10/1958 | Ownby | A47C 9/06 | 108/134 |
| 2,881,040 | A * | 4/1959 | Hartridge | A47B 77/10 | 182/33.6 |
| 3,030,166 | A * | 4/1962 | Baker | A47B 77/10 | 182/96 |

(Continued)

*Primary Examiner* — Daniel Cahn
(74) *Attorney, Agent, or Firm* — Dale J. Ream

(57) ABSTRACT

An in-cabinet step stool for use with a cabinet defining an interior area, the in-cabinet step stool including a framework having a pair of upstanding side walls, each side wall having a rear section and a front section extending forwardly and downwardly from the rear section. An upper step spans between upper edges of respective rear sections. A lower step spans between upper edges of respective lower sections. Each includes a rear foot having a rounded configuration such that the framework is pivotally movable thereon between a (1) deployed configuration in which the rear foot rests upon the bottom wall of the cabinet and the front section extends forwardly through the opening of the cabinet and a stored configuration in which the rear foot rests upon the bottom wall of the cabinet and the front section is inside the cabinet interior area.

15 Claims, 7 Drawing Sheets

(56) References Cited

U.S. PATENT DOCUMENTS 3,136,386 A * 6/1964 Jung ..... A47B 83/00 182/15
3,397,757 A * 8/1968 Greer ..... A47B 77/10 182/129
3,434,566 A * 3/1969 Miller ..... B62B 3/02 182/115
3,539,033 A * 11/1970 Schwarz ..... E04F 11/04 182/77
3,973,646 A * 8/1976 Martinez ..... E06C 9/02 182/106
4,135,604 A * 1/1979 Ryan ..... E06C 9/06 182/129
4,552,245 A * 11/1985 Lindberg, Jr. ..... E04H 4/144 182/87
4,556,125 A * 12/1985 Johnson ..... B60R 3/02 182/91
4,652,003 A * 3/1987 Karashima ..... B62B 5/00 182/127
4,716,987 A * 1/1988 Lindberg, Jr. ..... E04H 4/144 182/91
4,736,998 A * 4/1988 Wilson ..... A47B 83/02 297/140
4,757,876 A * 7/1988 Peacock ..... B60R 3/02 182/127
4,815,561 A * 3/1989 Ostrander ..... E06C 9/10 182/163
4,846,304 A 7/1989 Rasmussen
4,924,970 A * 5/1990 Seals ..... E06C 1/005 182/156
5,085,290 A * 2/1992 Guirlinger ..... E06C 1/005 182/77
5,094,515 A 3/1992 Low
5,131,492 A * 7/1992 Caminiti ..... A47B 46/005 182/156
6,003,633 A * 12/1999 Rolson ..... E06C 5/02 182/106
6,116,378 A * 9/2000 Barrow ..... B60R 3/02 182/127
6,378,720 B1 * 4/2002 Santa Cruz ..... B65F 1/062 182/91
6,425,457 B1 7/2002 Lundry
6,752,456 B1 6/2004 Latham
6,942,271 B1 * 9/2005 Jamison ..... B60R 3/007 14/71.1
7,716,757 B2 5/2010 Sumpton et al.
7,861,332 B2 1/2011 Sumpton et al.
8,037,557 B2 10/2011 Sumpton et al.
8,157,053 B1 * 4/2012 Lameiro ..... E06C 1/005 182/222
2006/0150315 A1 7/2006 Sumpton et al.
2010/0193292 A1 8/2010 Sumpton et al.
2011/0138531 A1 6/2011 Sumpton et al.
2012/0086317 A1 * 4/2012 Baran ..... A47B 77/10 312/237
2015/0001005 A1 * 1/2015 Goodson ..... A47B 77/00 182/96

* cited by examiner

IN-CABINET STEP STOOL

BACKGROUND OF THE INVENTION

This invention relates generally to folding and stepping furniture and, more particularly, a step stool that is mountable within a bathroom or kitchen cabinet and that is pivotal between a stored configuration entirely within the cabinet interior area and a deployed configuration partially inside the cabinet and partially extending forwardly of the cabinet.

Parents of young children are very familiar with brushing their children's teeth in the morning or before bed—an exercise that often times includes lifting the child up to the height of the sink or even sitting the child atop the sink cabinet. Positioning the child near the sink enables the child to spit out a mouthful of toothpaste or rinsing water. Eventually, the child becomes experienced enough to successfully brush his own teeth entirely. Unfortunately, the child may not be able to fully reach the sink or water faucet controls without a parent's assistance—leading to the child trying to find creative ways to elevate to the height of the sink. This may include inconvenience and difficult of retrieving a step stool from a utility closet and returning it to the closet following use.

Various step stool devices have been proposed in the art for assisting a child with stepping up to a sink. Although presumably effective for their intended purposes, the existing devices and patent proposals do not provide a step stool mounted within a cabinet and configured to be pivotally movable between a stored configuration completely contained within the cabinet and a deployed configuration partially extending forwardly of the cabinet.

Therefore, it would be desirable to have an in-cabinet step stool that fulfills the disadvantages and limitations of the prior art and the objective disclosed below.

SUMMARY OF THE INVENTION

An in-cabinet step stool according to the present invention for use with a cabinet having a bottom wall displaced upwardly from a floor surface and having a front side defining an opening giving access to the cabinet interior area, the in-cabinet step stool including a framework having a pair of upstanding side walls laterally spaced apart from one another, each side wall having a rear section and a front section extending forwardly and downwardly from the rear section. An upper step spans between upper edges of respective rear sections. A lower step spans between upper edges of respective lower sections. Each includes a rear foot having a rounded configuration such that the framework is pivotally movable thereon between a (1) deployed configuration in which the rear foot rests upon the bottom wall of the cabinet and the front section extends forwardly through the opening of the cabinet and a stored configuration in which the rear foot rests upon the bottom wall of the cabinet and the front section is inside the cabinet interior area.

Therefore, a general object of this invention is to provide an in-cabinet step stool that enables a young child to selectively deploy the step stool for use and then pivot the step stool to a storage configuration inside a sink cabinet.

Another object of this invention is to provide an in-cabinet step stool, as aforesaid, that includes a rear section mounted within the interior area of a cabinet and a front section that selectively extends forwardly of the cabinet.

Still another object of this invention is to provide an in-cabinet step stool, as aforesaid, having a configuration that, while positioned partially inside the cabinet and partly outside the cabinet, has level and parallel steps by which to step up to a cabinet sink.

Yet another object of this invention is to provide an in-cabinet step stool, as aforesaid, in which a rear section of the framework has a rounded configuration upon which the framework is pivotally movable without any other hardware.

A further object of this invention is to provide an in-cabinet step stool, as aforesaid, that is easily movable between storage and deployed configuration by a child.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
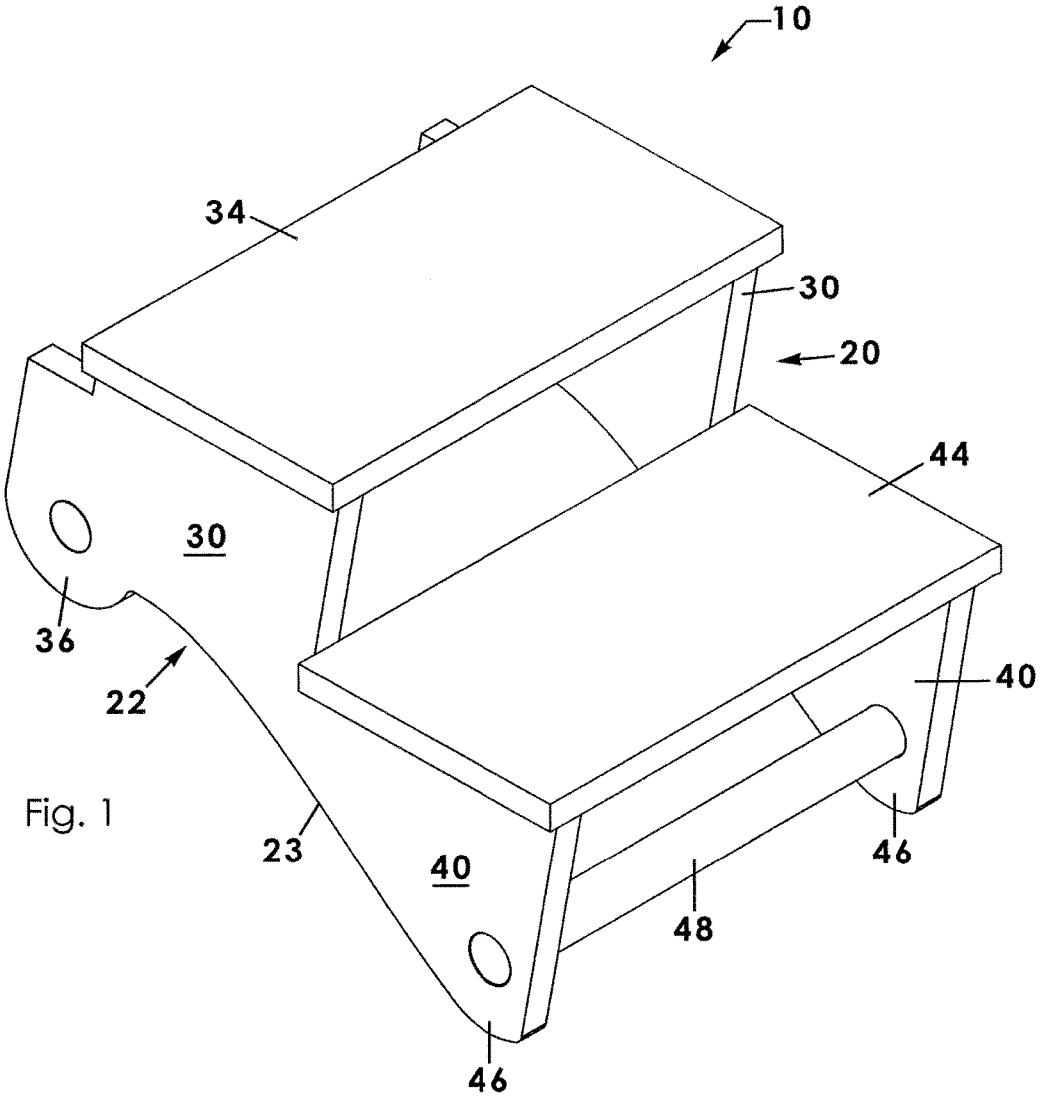
FIG. 1 is a perspective view of an in-cabinet step stool according to a preferred embodiment of the present invention.
Figure 2:
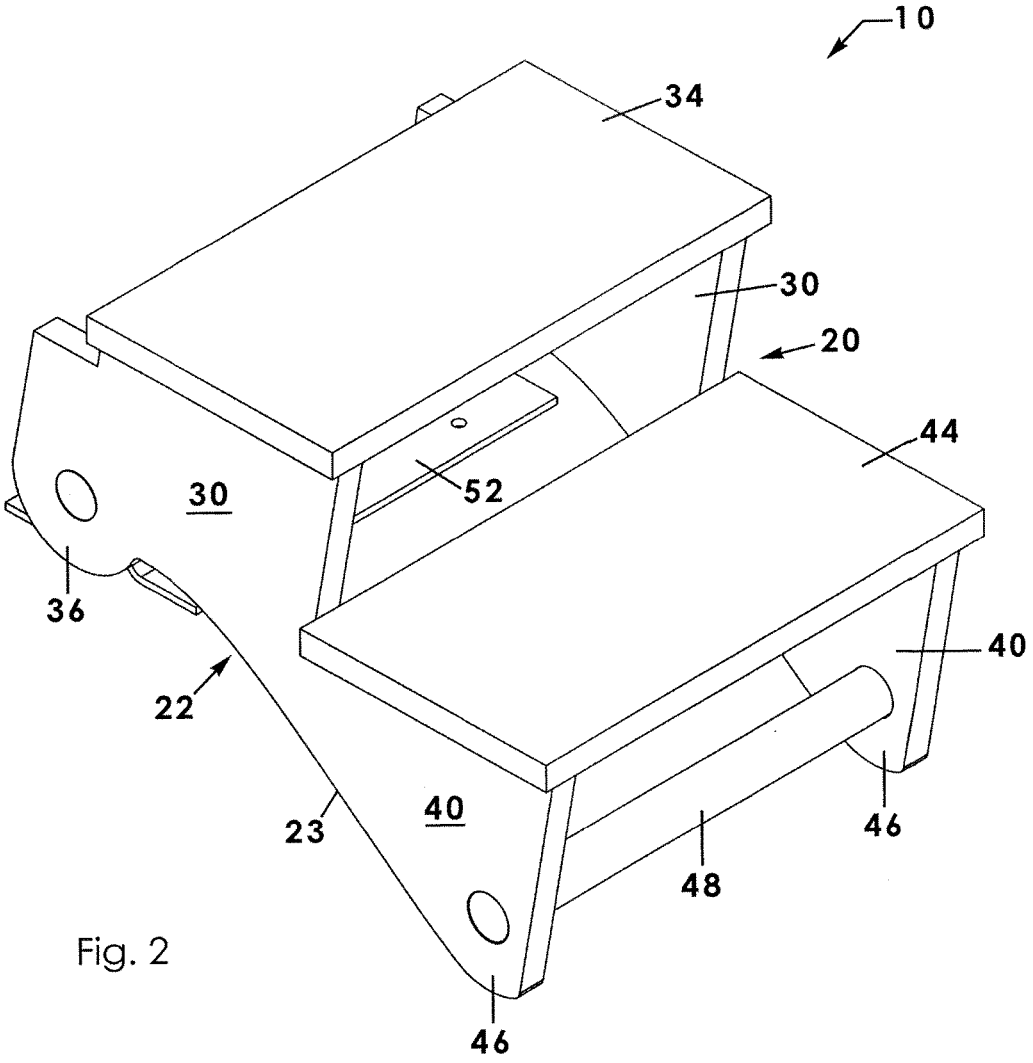
FIG. 2 is another perspective view of the in-cabinet step stool as in FIG. 1 illustrated with a base member and in a deployed configuration.

An in-cabinet step stool according to a preferred embodiment of the present invention will now be described in detail with reference to FIGS. 1 to 7*b* of the accompanying drawings. The in-cabinet step stool 10 includes a framework 20 having an upper step 34 and a lower step 44 spanning upstanding side walls 22 and having a rounded rear foot 36 that enables the framework to move between stored and deployed configurations relative to a cabinet 12, such as a bathroom sink cabinet.

The in-cabinet step stool 10 is for preferred use with a cabinet 12 of a type common to residential bathrooms (FIGS. 4-5), such as one having a bottom wall 14 that is displaced upwardly slightly from a bathroom floor surface 18. The cabinet 12 has a front side 16 that defines an opening that provides free access into the cabinet interior storage area. The opening may be selectively covered by one or more doors (not shown) in a traditional manner.

The framework 20 includes a pair of upstanding side walls 22 laterally spaced apart from and situated parallel to one another. Each side wall 22 has a thin profile and is preferably constructed of a wood material although an aluminum or other metal construction would also be suitable. When installed in a cabinet, the side walls 22 are preferably parallel to corresponding side walls of the cabinet itself. Each side wall 22 includes a rear section 30 and a front section 40 extending forwardly and downwardly from the rear section 30. In an embodiment, the rear section 30 and front section 40 of each side wall 22 has a unitary or singular construction, such as being cut from a single piece of wood.

An upper step 34 spans between upper edges 32 of respective rear sections 30 of each side wall 22. Similarly, a lower step 44 spans between upper edges of respective front sections 40 of each side wall 22. The upper step 34 is "stepwise" displaced upwardly and rearwardly from the lower step 44 so that a person, such as a toddler or young child, can step first on the lower step 44 and then the upper step 34 when the framework 20 is deployed in order to have access to a sink atop the cabinet 12.

Figure 4:
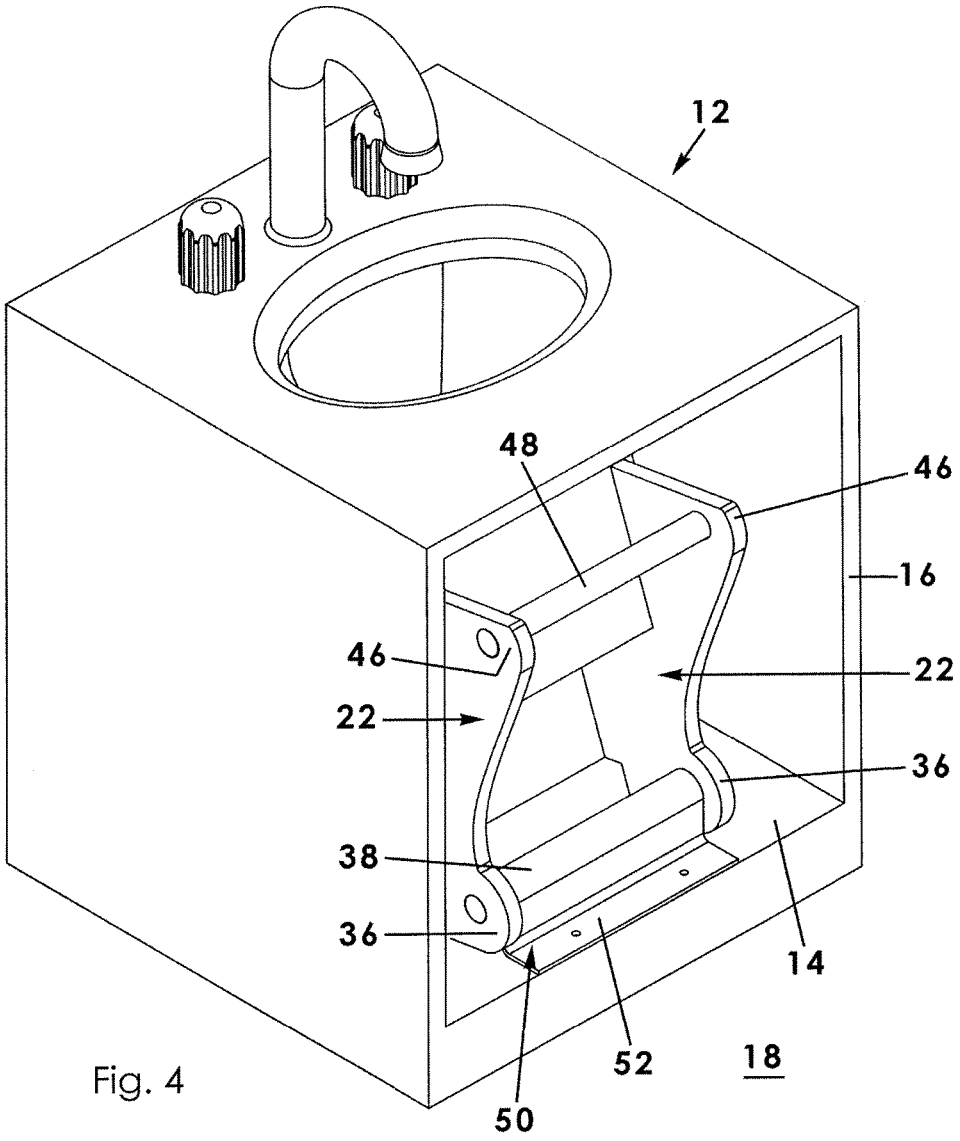
FIG. 4 is a perspective view of the in-cabinet step stool as in FIG. 1 illustrated mounted in a cabinet and in a stored configuration.
Figure 5:
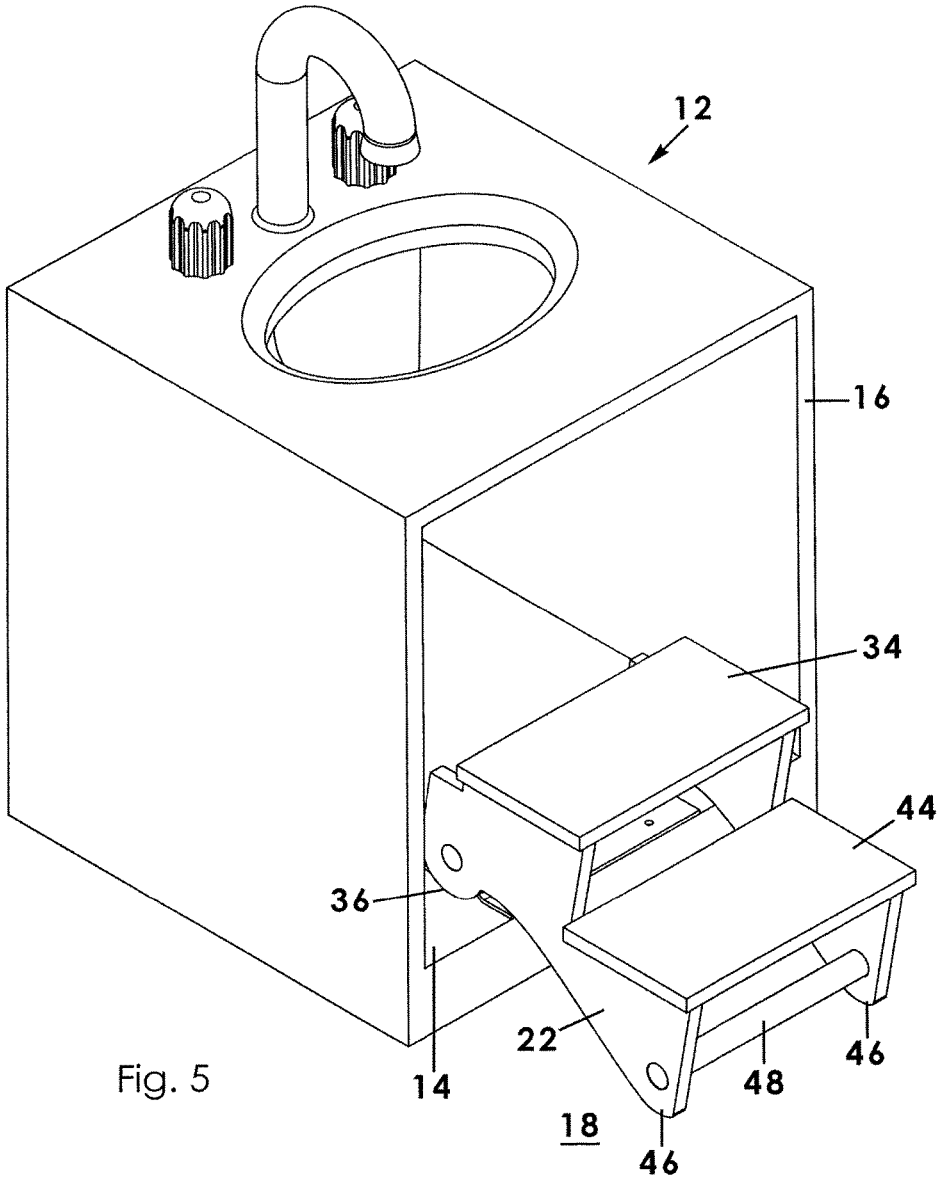
FIG. 5 is a perspective view of the in-cabinet step stool as in FIG. 1 illustrated mounted in a cabinet and in a deployed configuration.
Figure 6:
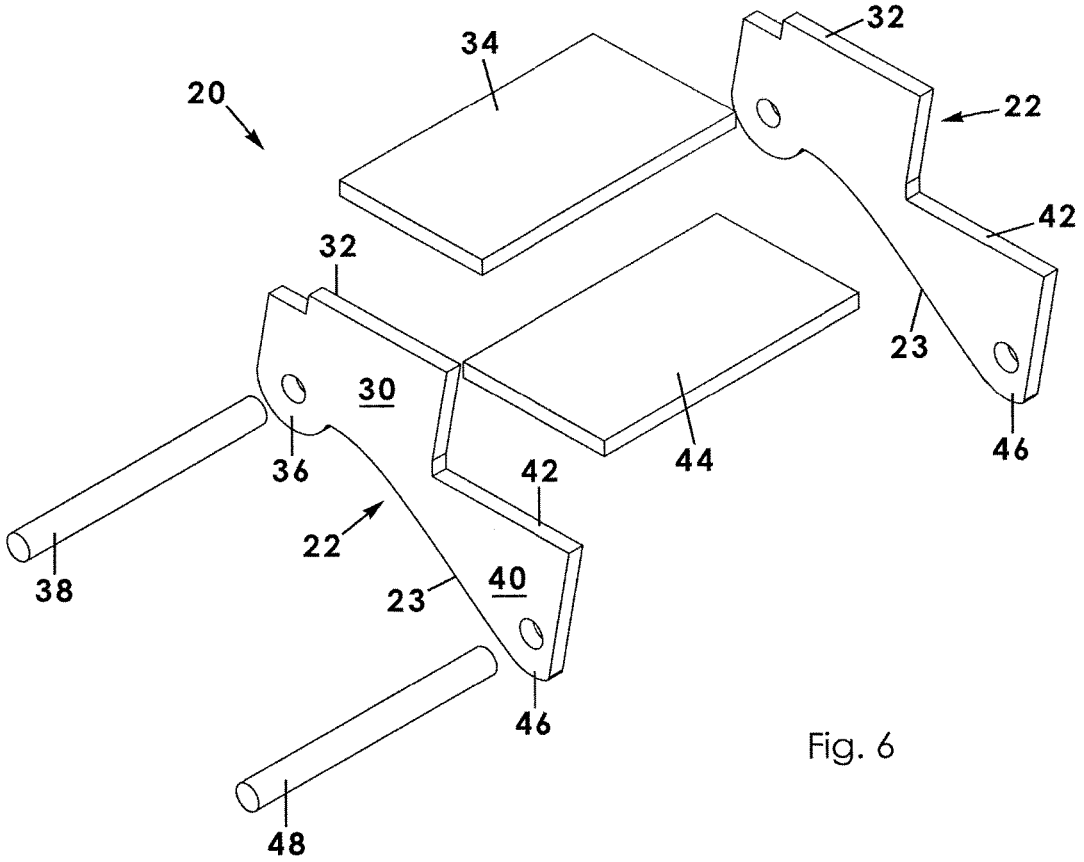
FIG. 6 is an exploded view of the framework of the in-cabinet step stool as in FIG. 1.
Figure 7A:
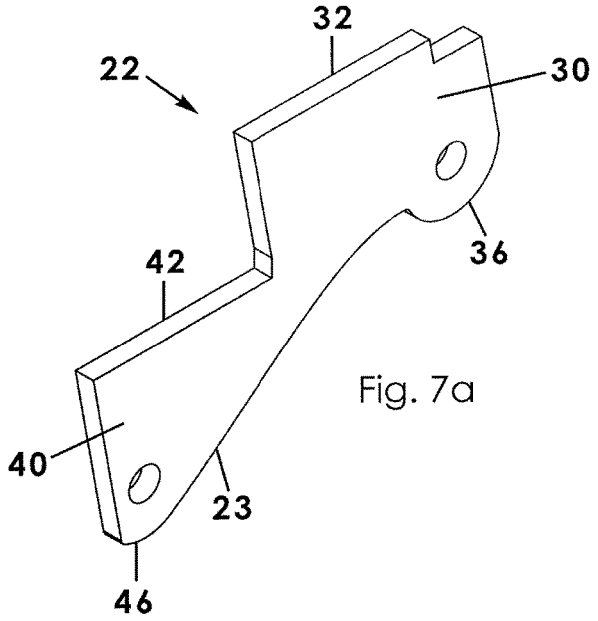
FIG. 7*a* a perspective view on an enlarged scale of a side wall of the framework.
Figure 7B:
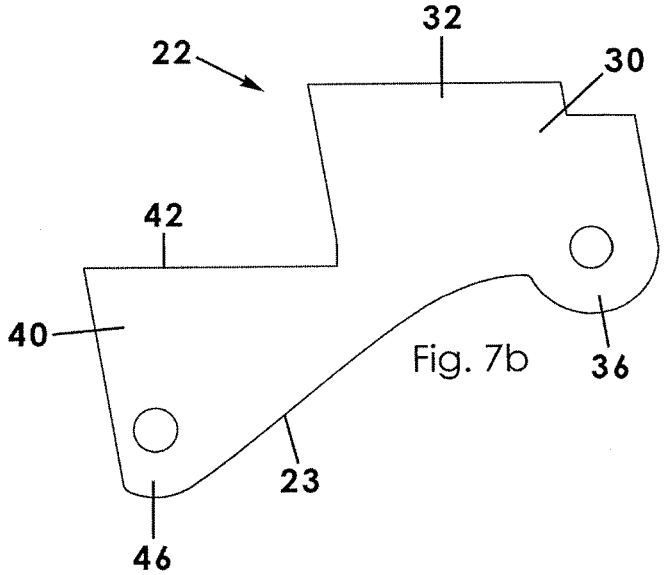
FIG. 7*b* is a side view of the side wall as in FIG. 7*a*.

Each rear section 30 includes a rear foot 36 having a rounded configuration in the likeness of a wheel such that the framework 20 may be pivotally movable thereon between a deployed configuration extending forwardly through the cabinet opening and a stored configuration in which the framework 20 is completely received inside the interior area of the cabinet 12. More particularly, at the deployed configuration the rear foot 36 rests upon the bottom wall 14 of the cabinet 12 while the front section 40 extends forwardly through the cabinet opening (FIG. 5). At the stored configuration, the rear foot 36 still rests upon the bottom wall of the cabinet 12 while the front section 40 is rotated upwardly into the interior area of the cabinet 12 (FIG. 4). A door (not shown) of the cabinet 12 may be closed so as to hide the framework 20 at the stored configuration.

The lower step 44 and upper step 34 have generally planar configurations and are parallel relative to one another. Both steps are also parallel to the bottom wall of the cabinet 12 and to the floor surface 18 when the framework is at the deployed configuration as described below. The front section 40 of each side wall 22 includes a front foot 46 configured to bear against a floor surface 18 beneath the cabinet 12 when the framework 20 is moved to the deployed configuration (FIG. 5). Each side wall 22 includes a lower span 23 that extends at a gentle downward angle between a respective rear foot 36 and a respective front foot 46. It is understood that the length of the side walls 22 and the downwardly angled lower spans 23 are distinguishing structures that enable the framework 20 to be partially mounted inside the cabinet 12 and partially outside the cabinet 12 at the deployed configuration whilst maintaining the steps in parallel relationship to one another, the floor surface 18, and the bottom wall 14 of the cabinet 12. No other step stool can provide this structure or function while being mounted in the cabinet 12 itself—both while stored and deployed.

Figure 3:
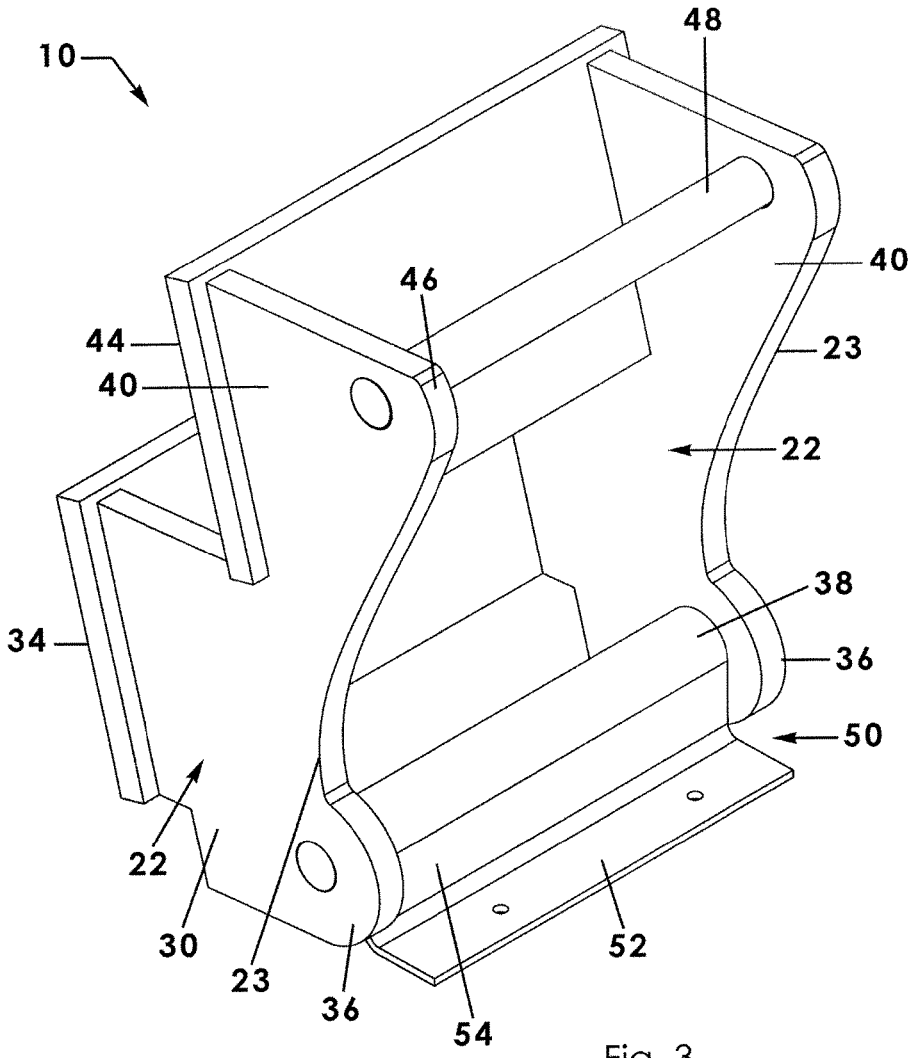
FIG. 3 is a perspective view of the in-cabinet step stool as in FIG. 1 illustrated in a stored configuration.

The framework 20 includes a rear support member 38 extending between and coupling together respective rear sections 30 of the pair of side walls 22. More particularly, the rear support member 38 may extend between inner surfaces of respective rear feet 36 (FIG. 3). Similarly, the framework 20 includes a front support member 48 extending between and coupling together respective front sections 40 of the pair of side walls 22. More particularly, the front support member 48 may extend between inner surfaces of respective front feet 46 (FIG. 3). As shown clearly in FIG. 3, the front support member 48 may be operated as a handle by which the framework 20 may be rotated about respective rear feet 36 between the stored configuration and the deployed configuration. It is understood that the rear support member 38 and front support member 48 may be cylindrical support rods; however, other configurations other than that of a cylindrical rod, such as a square or rectangular wood, iron stock bars would also work.

The in-cabinet step stool 10 may include a base member 50 for mounting the framework 20 inside the cabinet 12. The base member 50 is configured so that the side walls 22 of the framework 20 are movable between the deployed configuration and the stored configuration while maintaining a fixed position atop the bottom wall 14 of the cabinet 12. In other words, the base member 50 prevents the framework 20 from traveling across the bottom wall 14.

More particularly, the base member 50 includes an attachment section 52 selectively mounted to the bottom wall 14 of the cabinet 12 and a guide section 54 operatively coupled to the framework 20. The attachment section 52 may be generally flat/planar plate extending substantially between the rear feet 36 the rear section 30. The attachment section 52 may be mounted to the bottom wall 14 with screws or similar fasteners (FIG. 3). The guide section 54 may be pivotally coupled to the rear support member 38. Specifically, one edge of the guide section 54 may be fixedly attached to the rear support member 38 while an opposed edge thereof may be pivotally coupled to the attachment section 52 with a traditional hinge although a living hinge or even a spring steel construction would also work.

In use, the attachment section 52 of the base member 50 may be mounted to the bottom wall 14 of a cabinet and the framework 20 pivoted to the stored configuration—hidden from view within the interior area of the cabinet 12 (FIG. 4). When use of the step stool 10 is desired for easier access to the sink, a person (such as the toddler himself) may grasp the front support member 48 (a.k.a. the handle) and pivot the framework 20 to the deployed configuration (FIG. 5). The in-cabinet step stool 10 is stable in that the rear section 30 is mounted to the cabinet 12 while the front section 40 is extended forwardly of the cabinet 12. The shape configuration of the framework 20 enables the pivotal movement between stored and deployed configurations and the parallel configuration of the steps.

It is understood that while certain forms of this invention have been illustrated and described, it is not limited thereto except insofar as such limitations are included in the following claims and allowable functional equivalents thereof.

The invention claimed is:

1. An in-cabinet step stool configured to be used with a cabinet having a bottom wall displaced upwardly from a floor surface and having a front side that defines an opening giving access to a cabinet interior area, said in-cabinet step stool comprising:

a framework having a pair of upstanding side walls laterally spaced apart from one another, each side wall having a rear section and a front section displaced from and extending away from said rear section;

an upper step spanning between upper edges of respective said rear sections;

a lower step spanning between upper edges of respective lower sections, said upper step being stepwise displaced from said lower step;

wherein each rear section includes a rear foot having a rounded configuration defining a fulcrum such that said framework is pivotally movable on said rear foot between (1) a deployed configuration in which said rear foot rests upon the bottom wall of the cabinet while a portion between said rear and front sections extends through the opening of the cabinet and a front foot of each front section bears against the floor surface and (2) a stored configuration in which said rear foot rests upon the bottom wall of the cabinet and said front section is inside the cabinet interior area;

wherein each side wall, when at said deployed configuration, extends forwardly and downwardly from said rear section;

wherein said framework includes:

a rear support member coupling said rear sections together;

a front support member coupling said front sections together;

a base member having an attachment section capable of selective mounting to the bottom wall of the cabinet and a guide section operatively coupled to said framework, said base member configured so that a bottom rounded surface of the rounded configuration of each rear foot is configured to remain in contact with the bottom wall while each rear foot rolls between the deployed and stored configurations;

wherein:

said attachment section is a plate having a generally planar configuration capable of attachment to the bottom wall of the cabinet; and said guide section is pivotally coupled to said rear support member of said framework such that said framework is rotatably movable between said deployed configuration and said stored configuration while said rear support member remains adjacent said plate.

2. The in-cabinet step stool as in claim 1, wherein said upper step and said lower step are parallel to one another and configured to be parallel to the bottom wall of the cabinet when said framework is at said deployed configuration.

3. The in-cabinet step stool as in claim 2, wherein each front section includes the front foot that is configured to bear against the floor surface at said deployed configuration.

4. The in-cabinet step stool as in claim 3, wherein each side wall includes a lower span that extends at a downward angle between a respective rear foot and a respective front foot when viewed at said deployed configuration.

5. The in-cabinet step stool as in claim 1, wherein said front support member is a handle by which said framework is manually movable by a person between said deployed configuration and said stored configuration.

6. The in-cabinet step stool as in claim 1, wherein each side wall includes a lower span that extends at a downward angle between a respective rear foot and a respective front foot.

7. An in-cabinet step stool configured to be used with a cabinet having a bottom wall displaced upwardly from a floor surface and having a front side that defines an opening giving access to a cabinet interior area, said in-cabinet step stool comprising:

a framework having a pair of upstanding side walls laterally spaced apart from one another, each side wall having a rear section and a front section extending away from said rear section;

wherein said rear section includes an upper step spanning between upper edges of respective rear sections;

a lower step spanning between upper edges of respective lower sections, said upper step being stepwise displaced from said lower step;

wherein each rear section includes a rear foot having a rounded configuration defining a fulcrum such that said framework is pivotally movable on said rear foot between (1) a deployed configuration in which said rear foot rests upon the bottom wall of the cabinet while a portion between said rear and front sections extends through the opening of the cabinet and (2) a stored configuration in which said rear foot rests upon the bottom wall of the cabinet and said front section is inside the cabinet interior area;

wherein each side wall extends forwardly and downwardly from said rear section when viewed at said deployed configuration;

wherein each front section includes a front foot that is configured to bear against the floor surface at said deployed configuration;

wherein each side wall includes a lower span that, when viewed at said deployed configuration, extends at a downward angle between a respective rear foot and a respective front foot;

wherein said framework includes:

a rear support member coupling said rear sections together; and a front support member coupling said front sections together;

a base member having an attachment section capable of selective mounting to the bottom wall of the cabinet and a guide section operatively coupled to said framework, said base member configured so that a bottom rounded surface of the rounded configuration of each rear foot is configured to remain in contact with the bottom wall while each rear foot rolls between the deployed and stored configurations;

wherein:

said attachment section is a plate having a generally planar configuration capable of attachment to the bottom wall of the cabinet; and said guide section is pivotally coupled to said rear support member of said framework such that said framework is rotatably movable between said deployed configuration and said stored configuration while said rear support member remains adjacent said plate.

8. The in-cabinet step stool as in claim 7, wherein said upper step and said lower step are parallel to one another and configured to be parallel to the bottom wall of the cabinet when said framework is at said deployed configuration.

9. The in-cabinet step stool as in claim 7, wherein:

said rear support member is a support rod having a cylindrical configuration; and said front support member is a support rod having a cylindrical configuration.

10. An in-cabinet step stool for use with a cabinet having a bottom wall displaced upwardly from a floor surface and having a front side defining an imaginary vertical plane that defines a front access opening giving access to a cabinet interior area and a closed rear end, said in-cabinet step stool comprising:

a framework having a pair of upstanding side walls laterally spaced apart from one another, each side wall having a rear section and a front section displaced from and extending away from said rear section;

an upper step spanning between upper edges of respective rear sections;

a lower step spanning between upper edges of respective lower sections, said upper step being stepwise displaced from said lower step;

wherein each rear section includes a rear foot having a rounded configuration defining a fulcrum such that said framework is pivotally movable on said rounded rear foot in a rolling manner between (1) a deployed configuration in which said rear foot rests upon the bottom wall of the cabinet adjacent the front access opening of the cabinet while a portion between said rear and front sections extends forwardly through the front access opening of the cabinet and a front foot of each side wall of said front section bears against the floor surface and (2) a stored configuration in which said rear foot is rolled rearwardly and rests upon the bottom wall of the cabinet adjacent the front access opening of the cabinet and said front section is completely inside the cabinet interior area;

wherein each side wall, when viewed at said deployed configuration, extends forwardly and downwardly from said rear section;

a hinge configured to mount the bottom wall to a rear support member extending between the rear sections, wherein the hinge is configured to allow a bottom rounded surface of the rounded configuration of each rear foot to remain in contact with the bottom wall while each rear foot rolls between the deployed and stored configurations;

wherein said rear foot is positioned adjacent the front access opening of the cabinet at both said deployed configuration and at said stored configuration.

11. The in-cabinet step stool as in claim 10, wherein said upper step and said lower step are parallel to one another and configured to be parallel to the bottom wall of the cabinet when said framework is at said deployed configuration.

12. The in-cabinet step stool as in claim 11, wherein each front section includes the front foot that is configured to bear against the floor surface at said deployed configuration.

13. The in-cabinet step stool as in claim 12, wherein each side wall includes a lower span that, when viewed at said deployed configuration, extends at a downward angle between a respective said rear foot and a respective said front foot.

14. The in-cabinet step stool as in claim 13, wherein said rear section, when at said deployed configuration, is situated at a higher elevation than said front section.

15. The in-cabinet step stool as in claim 10, further in combination with said cabinet.

* * * * *